United States Patent [19]

Haber

[11] 4,181,304

[45] Jan. 1, 1980

[54] ILLUMINATED DICE AND STORAGE HOUSING

[76] Inventor: Terry M. Haber, 3029 S. Rosewood Ave., Santa Ana, Calif. 92707

[21] Appl. No.: 926,656

[22] Filed: Jul. 21, 1978

[51] Int. Cl.[2] ..... A63F 9/04; F21V 33/00

[52] U.S. Cl. ..... 273/146; 200/61.19; 362/253

[58] Field of Search ..... 273/146, 58 G, 138 A, 273/DIG. 24; 200/61.1, 61.19, 61.59, 153 M, DIG. 23; 307/143, 139; 362/394, 802, 155; 206/579, 315 R, 315 B

[56] References Cited

U.S. PATENT DOCUMENTS

| | | | |
|---|---|---|---|
| 1,363,567 | 12/1920 | Cobb | 273/146 X |
| 1,472,750 | 10/1923 | Gorman et al. | 200/153 M |
| 2,511,955 | 6/1950 | West | 200/153 M X |
| 2,604,557 | 7/1952 | Nelson | 200/61.59 |
| 2,903,820 | 9/1959 | Bodell | 273/58 G X |
| 2,942,379 | 6/1960 | Oman et al. | 273/58 G |
| 3,450,408 | 6/1969 | Hagerman | 273/146 |
| 4,124,881 | 11/1978 | Haber et al. | 362/253 |

FOREIGN PATENT DOCUMENTS

| | | | |
|---|---|---|---|
| 860161 | 12/1952 | Fed. Rep. of Germany | 273/138 A |

*Primary Examiner*—Richard C. Pinkham
*Assistant Examiner*—Arnold W. Kramer
*Attorney, Agent, or Firm*—Ralph B. Pastoriza

[57] ABSTRACT

Playing dice are provided with light emitting diodes in their interior together with a battery and master switch in each die. A light emitting diode is associated together with a gravity responsive switch in addition to the master switch for each die face, the arrangement being that the upward face of the die is illuminated after the dice are thrown. A storage housing is provided in combination with the dice, the housing including die receiving compartments having small projections for reception in small bores formed in one face of each die to open the master switch in each die so that there will not be drainage on the batteries when the dice are stored.

4 Claims, 3 Drawing Figures

ILLUMINATED DICE AND STORAGE HOUSING

BACKGROUND OF THE INVENTION

This invention relates generally to playing dice and more particularly to illuminated type dice in combination with a storage housing.

In copending patent application Ser. No. 826,355 filed Aug. 22, 1977, now U.S. Pat. No. 4,124,881, and entitled DICE WITH ILLUMINATING MEANS there are disclosed multi-faceted dice incorporating light emitting diodes. Energizing means such as batteries are provided in each die together with gravity responsive switches such that only an upwardly directed face of the die after it has been thrown will be illuminated by an associated light emitting diode. The particular dice disclosed in this copending application each have twelve faces. However, opposite faces always lie in parallel planes so that when the dice come to rest a given face will be facing upwardly in a horizontal plane. The dice disclosed in this copending application could have six faces; that is they could be cubical dice if desired.

With dice of the foregoing type, a master switch has been provided which can be manually operated to disconnect the battery from all of the light emitting diodes and associated gravity responsive switches so that there is no drain on the battery when the dice are not being used. However, a person may forget or neglect to operate this master switch when he is through playing with the dice with the consequence that the batteries run down and must be frequently changed.

SUMMARY OF THE PRESENT INVENTION

With the foregoing in mind, the present invention contemplates an illuminated die and a storage housing combination wherein the die incorporates a battery and light emitting means. A normally closed switch is provided in the die for connecting the battery to the light emitting means. The storage housing itself defines a die receiving compartment for the die and incorporates means responsive to the placing of the die therein to open the normally closed switch.

In the preferred embodiment, the housing structure includes first and second compartments in side-by-side relationship so that a pair of dice can be stored.

From the foregoing, it will be evident that by simply storing the dice, the energizing means in each die is automatically disconnected from the light emitting diodes thereby avoiding drain on the batteries.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
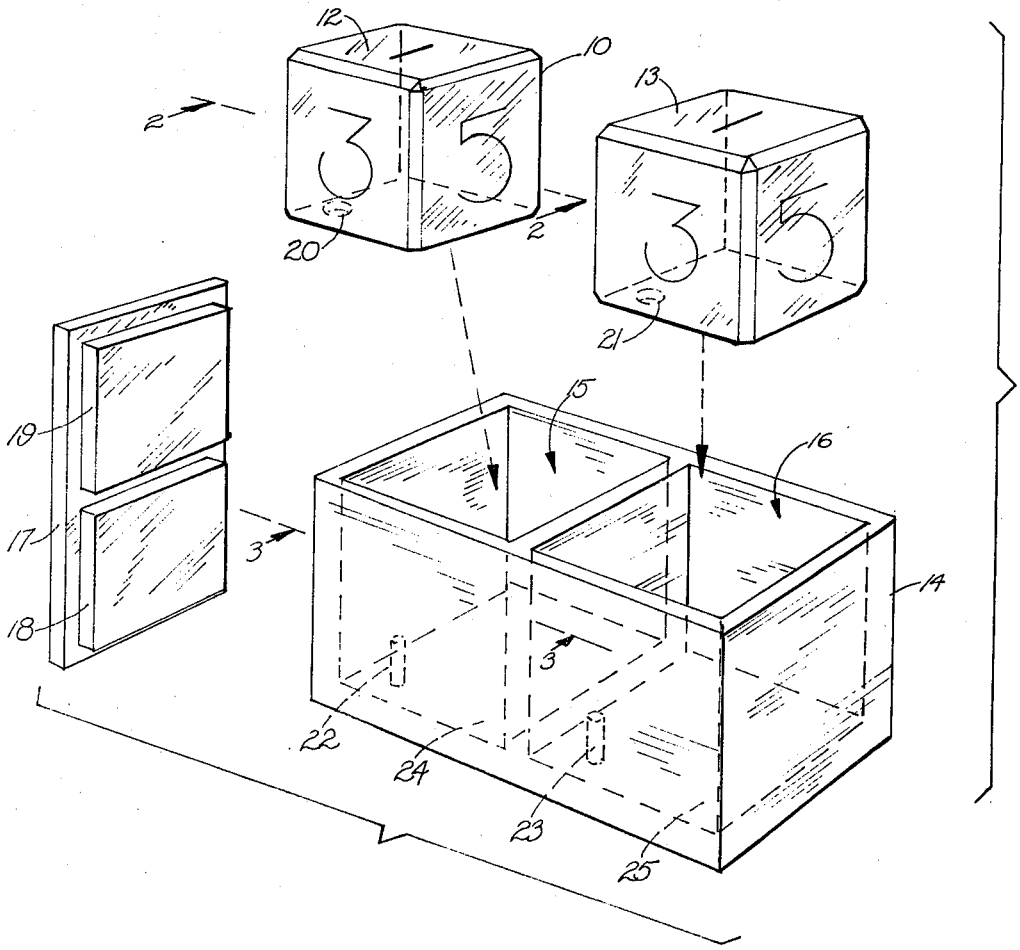
FIG. 1 is an exploded perspective view of the illuminated dice of this invention together with the storage housing therefor.

Referring first to FIG. 1, there are shown first and second dice 10 and 11 each having a plurality of faces such as 12 and 13 in which opposite surfaces lie in parallel planes. In the particular embodiment of FIG. 1, each of the dice is cubical in form and may have beveled edges and corners as shown to facilitate rolling.

A housing for said dice is shown at 14 and includes side-by-side die receiving compartments 15 and 16. These compartments are of inside dimensions corresponding to the outside dimensions of the dice so that the dice substantially fill the receiving compartments when placed therein. Where cubical dice are provided as shown in FIG. 1, the compartments would have cubical volumes.

A cover shown exploded to the left of the housing 14 may be provided as indicated at 17. The underside of this cover is provided with raised square areas 18 and 19 dimensioned to fit in the upper square openings of the compartments 15 and 16 to index the cover on the housing 14 after the dice 10 and 11 have been stored.

As will become clearer as the description proceeds, each die illustrated in FIG. 1 incorporates light emitting means, an energizing means for the light emitting means, and a normally closed master switch for connecting and disconnecting the energizing means to the light emitting means.

In addition, and as illustrated by phantom lines in FIG. 1, a given face of each die which constitutes the downwardly facing or opposite face to the faces 12 and 13 of the dice 10 and 11, is provided with a small bore. This bore for the die 10 is indicated at 20 and for the die 11 at 21 and is disposed adjacent one of the corners.

Each compartment 15 and 16 includes a projection indicated again by phantom lines at 22 and 23 on its floor designated 24 and 25 respectively. These projections are positioned to be received in the bores 20 and 21 when the dice 10 and 11 are placed in the compartments 15 and 16 with the given face oriented downwardly.

Figure 2:
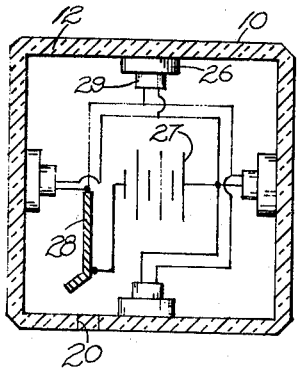
FIG. 2 is a cross section of one of the dice of FIG. 1 looking in the direction of the arrows 2—2; and, FIG. 3 is a fragmentary cross section of the housing of FIG. 1 illustrating the die of FIG. 2 in stored position therein.
Figure 3:
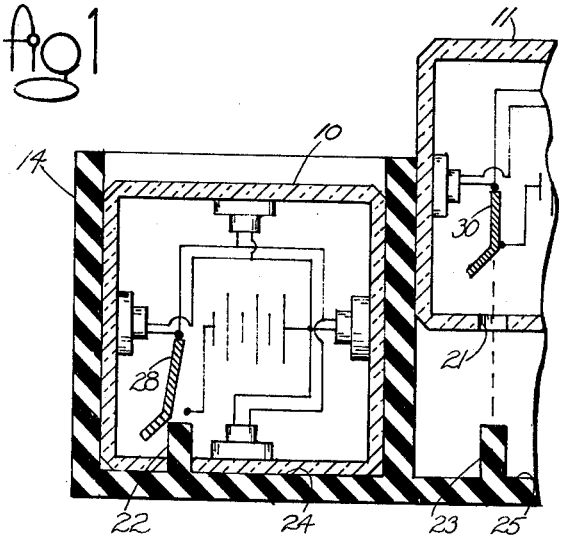

The foregoing described projections 22 and 23 serve to disconnect the master switch in each of the dice respectively when they are placed in the compartments, all as will become clearer by now referring to FIGS. 2 and 3.

Considering first the cross section of FIG. 2, the light emitting diodes associated with each face are shown one typical diode being indicated at 26 for the face 12. The energizing means comprises a battery incorporated in the die as indicated at 27, the master switch itself being shown at 28 disposed above the small bore opening 20.

As described briefly heretofore, there are also provided gravity responsive switches associated with each diode such as indicated by the block 29. Appropriate leads from the battery 27 connect through the master switch 28 and thence to the various gravity responsive switches and associated diodes. Each gravity responsive switch such as the switch 29 may be of the mercury type such as shown and described in detail in the heretofore referred to copending application Ser. No. 826,355. As indicated in FIG. 2, the master switch 28 is normally spring-biased to a closed position so that when the die is thrown and comes to rest, only the diode associated with the uppermost face is energized by way of its gravity switch. In FIG. 2, the diode 26 will thus be energized in the position shown, the gravity responsive switch 29 being closed so that the numeral or dots on the face 12 will be illuminated.

The other die 11 of FIG. 1 is identical in construction to the die described in FIG. 2.

Referring now to FIG. 3, there is shown the die 10 received within the die receiving compartment while the die 11 is shown partially received in the side-by-side compartment.

It will be noted with respect to the die 10 that when received with its given face having the bore 20 facing downwardly and properly oriented, the projection 22 will pass through the bore 20 and engage the master switch arm 28 biasing it away from the contact to an open position. Since both the bore and the projection 22 are disposed adjacent a corner of the die and the compartment respectively, there is only one way in which the die 10 can be received in the compartment to seat fully within the compartment. Thus, it is always assured that the projection 22 will pass within the bore and open the master switch and hold the same open.

The die 11 shown in a partially inserted position will also have its master switch designated by the numeral 30 biased to an open position when the projection 23 is received within the bore 21.

After both dice have been inserted in the housing compartments, the cover 17 described in FIG. 1 may be placed over the top of the housing with the raised square areas 18 and 19 seated in the upper portions of the compartments respectively to thereby properly index the cover.

From the foregoing, it will be evident that storing the dice in the housing 14 assures that the master switches in each die are in open condition so as to avoid drainage on the batteries. Moreover, the opening of the master switch is completely automatic and it will be appreciated that since the switches are normally biased to a closed position, when the dice are removed, the master switch will automatically reconnect to its associated battery contact so that the light emitting diodes are in condition for energization when playing with the dice.

Minor modifications falling within the scope and spirit of this invention will occur to those skilled in the art. The illuminated dice and storage housing are therefore not to be thought of as limited to the specific construction set forth merely by way of example.

I claim:

1. An illuminated die and a storage housing therefor including, in combination:

(a) a die incorporating battery and light emitting means;

(b) a normally closed switch in said die for connecting said battery to said light emitting means;

(c) a storage housing defining a die receiving compartment for said die; and (d) means in said compartment responsive to the placing of said die therein to open said normally closed switch.

2. The subject matter of claim 1, in which there is provided a second die similar to said first die, said housing including a second compartment incorporating means responsive to the placing of said second die therein to open the normally closed switch incorporated in said second die so that said housing serves as a storage means for dice.

3. Illuminated dice and a storage housing therefor including, in combination:

(a) first and second dice each having a plurality of surfaces in which opposite surfaces lie in parallel planes;

(b) light emitting means in each die;

(c) energizing means for said light emitting means in each die;

(d) a normally closed master switch in each die for connecting and disconnecting said energizing means to said light emitting means;

(e) a housing for said dice having side-by-side die receiving compartments of inside dimensions corresponding to the outside dimensions of the dice so that the dice substantially fill the receiving compartments when placed therein, each die having a bore extending into its interior from a given face; and (f) a projection on the floor of each die receiving compartment positioned to be received in said bore when said given face of a die is positioned downwardly to seat on said floor, said master switch means being located within said die so as to be automatically engaged by said projection to move to an open position whereby the master switch in each die is open when the dice are stored in said receiving compartments of said housing to avoid drainage of energy during storage.

4. The subject matter of claim 3, in which each die is in the form of a cube, each die receiving compartment having a cubical volume for receiving the die; and a cover having raised square areas on its underside dimensioned to be received in the upper opening of said compartments to index the cover in position on said housing.

* * * * *